United States Patent [19]

Brown

[11] Patent Number: 4,799,731

[45] Date of Patent: Jan. 24, 1989

[54] STADIUM SEAT COVER

[75] Inventor: John T. Brown, Cincinnati, Ohio

[73] Assignee: Stadium Bags, Inc., Cincinnati, Ohio

[21] Appl. No.: 48,887

[22] Filed: May 12, 1987

[51] Int. Cl.[4] ..... A47C 7/62

[52] U.S. Cl. ..... 297/192; 297/17; 297/144; 297/147

[58] Field of Search ..... 297/192, 194, 252, 230, 297/17, 143, 144, 147; 190/1, 8; 312/235 R; 298/505, 500

[56] References Cited

U.S. PATENT DOCUMENTS

| | | | |
|---|---|---|---|
| 66,228 | 7/1867 | Dotter | 297/192 X |
| 2,693,226 | 11/1954 | Schweighart | 297/192 |
| 3,083,053 | 3/1963 | Dorsey | 297/192 X |
| 3,318,456 | 5/1967 | Lipe | 297/194 X |
| 4,527,830 | 7/1985 | Meyers | 297/192 |
| 4,556,250 | 12/1985 | Chapman et al. | 297/192 |
| 4,652,048 | 3/1987 | Nazer | 297/192 |

FOREIGN PATENT DOCUMENTS

| | | | |
|---|---|---|---|
| 376718 | 1/1931 | United Kingdom | 297/194 |
| 649000 | 1/1951 | United Kingdom | 297/17 |

*Primary Examiner*—Kenneth J. Dorner
*Assistant Examiner*—Laurie K. Cranmer
*Attorney, Agent, or Firm*—Edward J. Utz

[57] ABSTRACT

The device consists of a stadium seat cover which is slid over the seat portion of a stadium type chair. A pouch is attached to the cover and is provided with a member which has openings for receiving cups and the like and is manually positioned between side attachments to the inside of the pouch.

1 Claim, 2 Drawing Sheets

STADIUM SEAT COVER

This invention relates to a stadium seat cover with an article holder and a pouch for carrying objects into a stadium.

In the modern stadium joined rows of chairs are provided which are attached to the supporting surface and remain in predetermined rows. The chairs are provided with a hinged seat portion to permit easy passage between the rows of the chairs.

It is the object of this invention to provide a stadium seat cover with an article holder and a pouch for carrying coats and the like into the stadium. A stadium seat cover is desirable because of the generally dirty condition of stadium facilities and the article holder permits the temporary placement of drinks and other products in a safe manner and not on the floor or in the user's hands.

It is a further object of this invention to provide space for storing purses, coats and other items which are accessible only by the person using the stadium seat cover.

It is a further object of this invention to provide a seat cover which is lightweight and easily transported by the user.

Still another object of this invention is to provide a seat for holding beverage containers which is readily and easibly assembled and is of such construction that it will not easily deflect so as to cause spillage when used.

Another object of this invention is to provide a rack which may be disassembled when not in used and not interfere with passage between rows of seats.

Other objects and details of construction will appear from the detailed description to follow. The invention is described in the drawings, in which.

In the drawing the same reference numerals refer to the same parts throughout.

DESCRIPTION OF THE INVENTION

Figure 1:
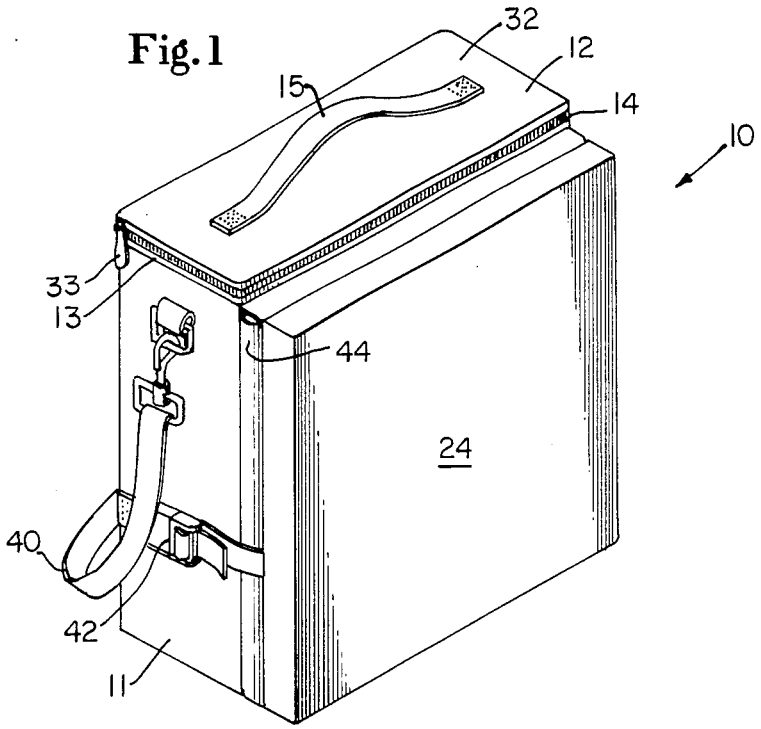
FIG. 1 is an isometric view of the stadium seat.

In FIG. 1 the stadium seat cover is shown in the configuration for carrying to and from the stadium. The structure 10 includes a storage pouch 11 having a cover 12 attached to the body of the device 13. A zipper 14 serves to secure the cover 12 to the pouch body 13. A handle is attached to the cover 12 to permit carrying the device 10 to and from the stadium. A variety of articles, such as coats and blankets can be enclosed within the storage pouch 11.

Figure 2:
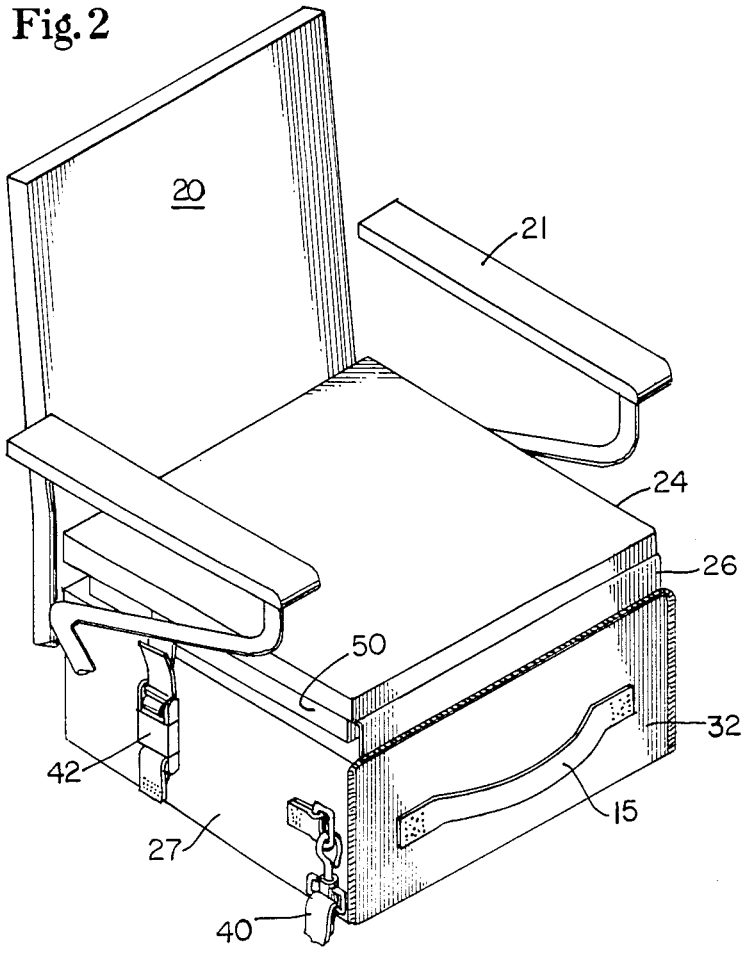
FIG. 2 is an isometric view of the stadium seat cover with the rack for holding beverages and the pouch in a close configuration.
Figure 3:
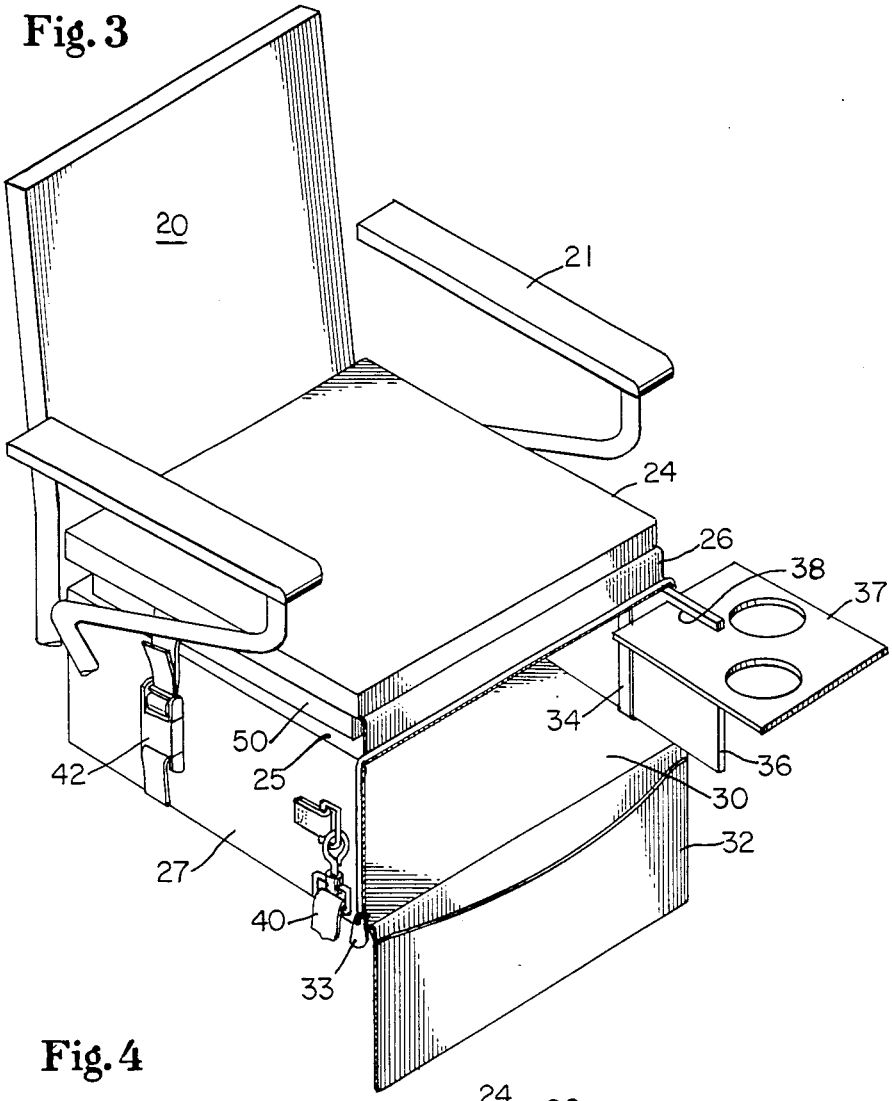
FIG. 3 is a view showing the beverage holder extended from the side portion of the stadium seat in it assembled condition.

The stadium seat cover is easily and readily attached to a stadium type chair 20. The stadium type chair is indicated generally as 20 in FIGS. 2 and 3 and has chair arms such as 21. The stadium seat cover comprises a cushion member 24 (FIG. 4) which is attached to a cover member 25 by means of a flexibile strip 26. The cover member 25 has two fixed side members 27, a back member 28 and a corresponding side member and has a bottom member 29 to form a pouch for storing and carrying articles. The storage compartment indicated generally at 30 is secured at its front by a cover 32 which is integral with bottom member 29 and is flexible and is maintained in its closed position by a zipper closure 33 to firmly attach the cover 32 on all four sides of the storage compartment 30.

Figure 4:
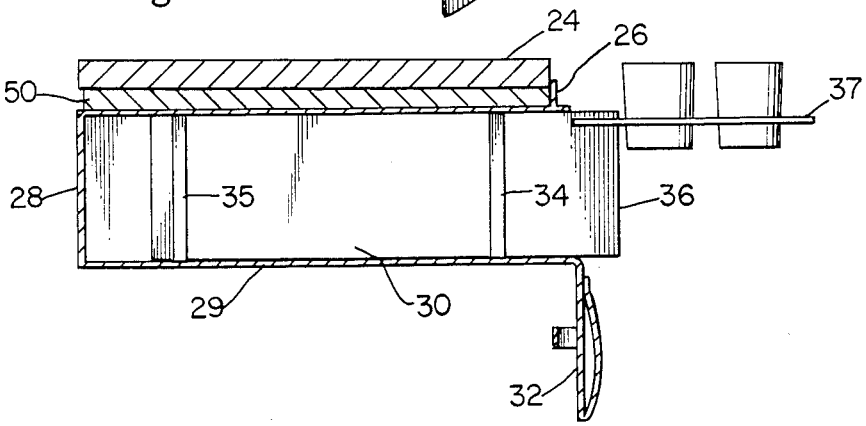
FIG. 4 is a sectional view of a portion of the structure shown in FIG. 3.

The side members 27 have a pair of elastic strips 34 and 35 secured to them at the inside and constitute a retaining device for thermoplastic slides 36 which are provided with a holder 37 containing openings to receive cups and the like. (As shown in FIG. 4) The holder 37 is removably secured in a slot 38 formed in slide 36. Two such slides are provided one for each side of the stadium seat and are held in position by the elastic members 34 and 35. An extra cushion 44 is provided to be used by the companion of the carrier of the stadium seat and article holder and is carried with it. The member 32 is provided with a handle 15 and a carrying strap 40 which may be used alternatively to the handle 15. Side buckles such as 42 are attached to the underside of member 24 and to the bottom of member 29 and are releasable to permit the unfolding of the seat 24 relative to the article holder 30.

In practice the article holder which may be used to carry blankets and the like has the buckle members 42 released, so that the cushion 24 fits over a stadium seat such as 50, which is hingedly connected to the stadium chair. The extra cushion 44 may be used for a companion and the zippered cover 32, is opened, the members 36 are slid to the front, the holder 37 which is carried in the pouch or article holder is positioned on the side members 36 to receive cups or other items.

In practice I have found this to be a very useful item since all items such as blankets and gloves may be carried in the pouch as well as providing for a cup receptacle at each side of the stadium seat.

Having thus described my invention, I claim:

1. A stadium seat cover comprising a member sized and shaped to slide over a seat portion of a stadium type chair, a pouch attached to the member slidable over said seat portion, a top side to said pouch, depending sides attached to said top side, a back side secured to said top side and said depending sides, a bottom side secured to said back side and said depending sides, a pair of elastic strips secured to each depending side, a slide member adapted to be removably positioned between either of said pair of elastic strips and its depending side, a holder removably positioned to said slide member, a front cover flexibly secured at its lower edge to said bottom side, and a slidable fastener secured to the front edge of said depending sides and the top side.

* * * * *